US011066714B2

(12) United States Patent
Ehmann

(10) Patent No.: US 11,066,714 B2
(45) Date of Patent: Jul. 20, 2021

(54) BATCH FURNACE FOR ANNEALING MATERIAL AND METHOD FOR HEAT TREATMENT

(71) Applicant: Gautschi Engineering GmbH, Berg TG (CH)

(72) Inventor: Rainer Ehmann, Bodman-Ludwigshafen (DE)

(73) Assignee: GAUTSCHI ENGINEERING GMBH, Berg TG (CH)

( * ) Notice: Subject to any disclaimer, the term of this patent is extended or adjusted under 35 U.S.C. 154(b) by 0 days.

(21) Appl. No.: 15/672,907

(22) Filed: Aug. 9, 2017

(65) Prior Publication Data

US 2018/0044746 A1 Feb. 15, 2018

(30) Foreign Application Priority Data

Aug. 10, 2016 (DE) ..... 10 2016 114 841.5

(51) Int. Cl.
*C21D 1/767* (2006.01)
*C21D 9/54* (2006.01)
(Continued)

(52) U.S. Cl.
CPC ..... *C21D 1/767* (2013.01); *C21D 1/40* (2013.01); *C21D 9/525* (2013.01); *C21D 9/54* (2013.01);
(Continued)

(58) Field of Classification Search
CPC . C21D 1/767; C21D 1/40; C21D 9/54; C21D 9/68; C21D 9/525; F27D 2007/045; F27C 15/325; F27B 17/0016
(Continued)

(56) References Cited

U.S. PATENT DOCUMENTS 2,220,797 A * 11/1940 Bates ..... C21D 9/54 266/255
3,019,006 A * 1/1962 Lillienberg ..... C21D 9/663 266/249
(Continued)

FOREIGN PATENT DOCUMENTS

DE 3035032 C1 8/1982
DE 42 43 127 A1 6/1994
(Continued)

OTHER PUBLICATIONS

Office Action prepared by the German Patent Office DPMA dated Apr. 13, 2017 in German Patent Application DE 10 2016 114 841.5, partial machine translation provided.
(Continued)

*Primary Examiner* — Steven B McAllister
*Assistant Examiner* — Benjamin W Johnson
(74) *Attorney, Agent, or Firm* — Hassan Abbas Shakir; Shakir Law PLLC

(57) ABSTRACT

A batch furnace for annealing material, in particular a single chamber furnace or single coil furnace, with a furnace housing. The batch furnace has a closable charging opening, a receiving chamber for receiving furnace material, and a device for convective heat transfer onto the furnace material by a heat transfer medium. The batch furnace includes at least one fan, which is arranged in the furnace housing, at least one heating device for the heat transfer medium and/or at least one inlet for an externally heated heat transfer medium, wherein the heating device and/or the inlet is arranged directly in front of the intake side or directly behind the pressure side of the fan or circumferentially in an annular gap between the fan and the furnace housing, and a receiving chamber for the furnace material, which is arranged on the pressure side of the fan.

18 Claims, 4 Drawing Sheets

(51) Int. Cl.

| | |
|---|---|
| ***C21D 1/40*** | (2006.01) |
| ***C21D 9/52*** | (2006.01) |
| ***C21D 9/68*** | (2006.01) |
| ***F24C 15/32*** | (2006.01) |
| ***F27B 17/00*** | (2006.01) |
| *F27D 7/04* | (2006.01) |

(52) U.S. Cl.
CPC ..... *C21D 9/68* (2013.01); *F24C 15/325* (2013.01); *F27B 17/0016* (2013.01); *F27D 2007/045* (2013.01)

(58) Field of Classification Search
USPC ..... 432/176, 159, 183
See application file for complete search history.

(56) References Cited

U.S. PATENT DOCUMENTS 3,796,533 A * 3/1974 Vox ..... B29C 35/04 425/429
4,408,986 A * 10/1983 Soraya ..... C21D 1/767 432/6
4,817,920 A * 4/1989 Erfort, Jr. ..... C21D 9/0037 266/252
4,854,860 A * 8/1989 Hemsath ..... C21D 1/767 432/176
4,963,091 A 10/1990 Hoetzl et al.
5,449,422 A * 9/1995 Pflanz ..... C21D 1/767 148/601
5,449,442 A 9/1995 Pflanz et al.
5,910,006 A * 6/1999 Conroy ..... F27B 17/02 432/250
2009/0178738 A1* 7/2009 Chretien ..... C21D 9/0018 148/559

FOREIGN PATENT DOCUMENTS

DE 102 27 499 A1 2/2003
DE 102009009407 A1 8/2010

OTHER PUBLICATIONS

European Search Report issued by the European Patent Office dated Dec. 8, 2017 in EPO patent application EP 17185513.3, partial machine translation provided.
Office Action issued by the German Patent Office dated Aug. 3, 2018 in German patent application DE 10 2016 114 841.5, partial machine translation provided.

* cited by examiner

BATCH FURNACE FOR ANNEALING MATERIAL AND METHOD FOR HEAT TREATMENT

BACKGROUND OF THE INVENTION

1. Field of the Invention

The invention relates to a batch furnace for annealing material and a method for heat treatment.

2. Discussion of the Related Art

In industrial furnace construction, a differentiation is made between continuous furnaces and batch furnaces. Batch furnaces have an enclosed furnace chamber, in which an individual batch is heat-treated. Examples of batch furnaces are single coil furnaces, which enable a flexible and individual heat treatment of individual coils. A further example of a batch furnace are so-called chamber furnaces, which are used for the heat treatment of coils, billets and rolling ingots. Such a chamber furnace is known for example from DE 102 27 499 A1.

Known batch furnaces have flow directing systems for example with nozzles, which direct and introduce the heat transfer medium in the furnace chamber and act upon the batch, situated in the furnace chamber, with the heat transfer medium for convective heat transfer. The batch is to be heated as homogeneously as possible here, in order to prevent damage to the batch through local overheating and to achieve as uniform material properties as possible.

For this, the chamber furnace according to DE 102 27 499 A1 enables a relative movement between the nozzles in the furnace chamber and the batch which is to be heated. The relative movement is achieved in that the nozzle system and/or the batch are rotatable.

The single coil furnace is similarly constructed and has a single chamber in which a single coil is heat-treated. As in the case of the chamber furnace, flow channels are provided with nozzles which direct the heat transfer medium onto the coil. Beneath or in front of the single coil furnace, a charging unit is arranged. With the charging from below, the furnace is mounted in a steel frame which creates space for the handling of the coils beneath the furnace.

The known chamber furnaces and single coil furnaces are complex in construction and relatively large, which leads to correspondingly great energy losses or respectively correspondingly extensive thermal insulation measures.

SUMMARY OF THE INVENTION

The invention is based on the problem of improving a batch furnace of the type named in the introduction to the effect that a greater efficiency of the heat treatment is achieved in a simple manner. The invention is based furthermore on the problem of indicating a method for heat treatment.

The invention is based on the idea of indicating a batch furnace, in particular a single chamber furnace or a single coil furnace, with a furnace housing. The furnace housing has a closable charging opening, a receiving chamber for furnace material, in particular a single receiving chamber, and a device for the convective heat transfer to the furnace material through a heat transfer means. In the furnace housing at least one fan is arranged. The batch furnace has at least one heating device for the heat transfer means and/or at least one inlet for an externally heated heat transfer medium. The heating device is arranged directly in front of the intake side or directly behind the pressure side of the fan or circumferentially in an annular gap between the fan and the furnace housing. The position of the inlet for the externally heated heat transfer medium can be situated at any desired location of the furnace which enables access to the interior of the furnace, i.e. to the receiving chamber for the furnace material, so that the externally heated heat transfer medium can arrive into the receiving chamber. Preferably, the inlet for an externally heated heat transfer medium is arranged directly in front of the intake side or directly behind the pressure side of the fan or circumferentially in the annular gap between the fan and the furnace housing. However, the invention is not restricted to this arrangement.

In other words, at least one heating device for the heat transfer medium is arranged directly in front of the intake side or directly behind the pressure side of the fan or circumferentially in the annular gap between the fan and the furnace housing. Alternatively or additionally, at least one inlet for an externally heated heat transfer medium is arranged directly in front of the intake side or directly behind the pressure side of the fan or circumferentially in the annular gap between the fan and the furnace housing or at any desired location which enables an access into the interior of the furnace, i.e. to the receiving chamber.

The receiving chamber for the furnace material is arranged on the pressure side of the fan. This means that the receiving chamber can be arranged directly behind the pressure side of the fan or further distant from the pressure side.

The gaseous medium is drawn in on the intake side of the fan. On the pressure side of the fan, the gaseous medium leaves the fan with increased pressure.

The invention has several advantages.

The invention named here manages without nozzles or respectively a nozzle system, which is used in the prior art in order to act upon the furnace material with the heat transfer medium. Thereby, the flow channels provided in the prior art, which are arranged in the receiving chamber of the furnace housing and provide the nozzles with the heat transfer medium, are dispensed with. One therefore also speaks of an open volume of the furnace housing. The elimination of the flow channels and of the nozzles shortens the flow paths and reduces the pressure losses. With regard to a single coil furnace, the invention enables the reducing in size of the intake region of the fan above the furnace material or respectively the coil. The flushing losses with the use of a protective gas atmosphere are reduced owing to the efficiently used furnace volume. Through the compact construction, the space requirement of the furnace and the outer surface of the furnace which is to be insulated are reduced. Thereby, heat losses are reduced without additional heat insulation measures.

Hot air, exhaust gas or protective gas come into use for example as heat transfer medium, depending on the furnace material.

The batch furnace according to the invention is particularly well suited for the heat treatment of aluminum annealing material, in particular aluminum coils.

According to the invention, the heat transfer medium can be heated in various ways.

In a variant, a heating device is associated with the fan. The heating device is arranged directly in front of the intake side of the fan or directly behind the pressure side of the fan or circumferentially in the annular gap between the furnace housing and the fan. It is also possible that a heating device, in particular first heating device, is arranged directly in front of the intake side of the fan and/or a heating device, in particular second heating device, is arranged directly behind the pressure side of the fan and/or a heating device, in particular third heating device, is arranged circumferentially in the annular gap between the furnace housing and the fan.

In other words, the heating device, just as the fan, is arranged in the furnace housing.

With the heating device arranged directly in front of the intake side of the fan, the heat transfer medium which is drawn in by the fan flows past the heating device and in so doing is heated by the latter. The heated heat transfer medium flows through the fan and exits from the fan on the pressure side. In so doing, the heat transfer medium can pass a further heating device, can receive heat and can then flow into the receiving chamber. Alternatively, the heated transfer medium can be introduced directly out from the fan into the receiving chamber, where the heat transfer medium impinges onto the furnace material. The receiving chamber is arranged directly behind the pressure side of the fan.

With the heating device arranged directly behind the pressure side of the fan, the cool heat transfer medium flows through the fan and exits therefrom on the pressure side. Subsequently, the heat transfer medium passes the heating device and receives heat. The receiving chamber is arranged downstream of the heating device in the direction of flow, so that the furnace material situated in the receiving chamber is acted upon by the heated heat transfer medium.

With the use of a heating device which is arranged circumferentially in the annular gap between furnace housing and fan, the heat transfer medium flows from the receiving chamber of the furnace via the annular gap back in the direction of the intake side of the fan, and heats up within the annular gap.

In gas-heated furnace installations, a differentiation is basically made between two possible heating types. Either the burner fires directly into the furnace. Then one speaks of a direct heating device, because the exhaust gases constitute the heat transfer medium. In the indirect heating device, the burner fires within a closed circuit into a jet pipe. The hot pipe then transfers the heat to the heat transfer medium. This means that no exhaust gas arrives into the interior of the furnace. Both types are represented in the aluminum sector.

A further variant consists in that instead of, or in addition to, the heating device, at least one inlet for an externally heated heat transfer medium, for example the exhaust air of another furnace installation, is associated with the fan.

The inlet in combination with a jet pipe can be arranged directly in front of the intake side or directly behind the pressure side or in the annular gap between furnace housing and the fan. It is also possible that a plurality of inlets in combination with a jet pipe are provided, which open out, directly in front of the intake side and directly behind the pressure side of the fan and in the annular gap between furnace housing and fan, into the furnace chamber or respectively the receiving chamber. It is likewise possible that the inlet can occur at any desired location without the use of a jet pipe. Through the inlet, a heat transfer medium, preferably hot air or hot protective gas, or with the use of a jet pipe also hot exhaust gases, can be delivered to the batch furnace, which is heated externally, i.e. outside the furnace. It is possible to combine one or more inlets for the externally heated heat transfer medium with one or more heating devices, for example in order to bring a preheated heat transfer medium in the furnace through the heating device to the desired final temperature.

The fan arranged in the furnace housing leads to shorter flow paths, compared to the known nozzle systems, and therefore smaller pressure losses being realized in the furnace housing.

Preferably, the receiving chamber is free of nozzle channels. This has the advantage that the useful volume is increased.

In a preferred embodiment, the heating device has an electric resistance heating and/or a heating line for a gaseous heating medium. The heating line can also be designated as a jet pipe. The resistance heating has the advantage of simple regulation. The heating line has the advantage that exhaust gases from other furnaces can be used for heating the batch furnace. The exhaust gases do not arrive directly into the batch furnace, but rather are directed through the heating line, which emit the heat, so that the furnace atmosphere is not impaired. Other heating media can be used instead of exhaust gases.

Preferably, a plurality of fans, in particular 2 fans, are arranged in facing arrangement on both sides of the receiving chamber. At least one heating device and/or at least one inlet for an externally heated heat transfer medium is associated with each fan. The heating device or respectively the inlet for the externally heated heat transfer medium and the respectively associated fan form a unit, which realizes the device for the convective heat transfer.

This embodiment has the advantage that the furnace material is heated uniformly from two sides. The embodiment is suited particularly, but not only, for the heating of coils, in particular aluminum coils.

In the further preferred embodiment, the receiving chamber of the batch furnace is configured substantially hollow-cylindrically. The fans are arranged on the face sides of the receiving chamber. Thereby, a particular compact construction of the batch furnace is achieved, which enables a quick, efficient and homogeneous heating of the furnace material.

Preferably, the fan has a drive which is arranged outside the furnace housing. This has the advantage that the fan drive is exposed to no or to a relatively small thermal stress, so that no particular measures have to be provided for the drive with regard to thermal insulation or heat dissipation.

When an annular gap is formed between the fan and the furnace housing for the circulation of the heat transfer medium, a particularly compact construction is achieved, which manages without any particular installations for the circulation in the furnace housing.

The charging opening can be closable by a cover or by a plurality of cover elements. The cover or respectively the cover elements are pivotable about a rotation axis running in the longitudinal direction of the housing. The fan is arranged in the stationary part of the furnace housing. This embodiment is suited in particular for cylindrical batch furnaces, the furnace housing of which is divided once or several times in longitudinal direction and thus forms the cover or respectively the cover elements. In this embodiment, the furnace material, in particular the coil, can be charged from above by means of a crane with coil gripper.

The charging opening can be closable alternatively by at least one face-side wall element of the furnace housing, which is pivotable about a rotation axis running in transverse direction of the housing. The face-side wall element is connected to the fan. This has the result that the fan, together with the face-side wall element, is pivoted during opening or respectively closing of the charging opening. The charging of the batch furnace takes place from the front or respectively from the rear by means of a C-hook or stacker. In combination with a cover, a coil gripper can also be used.

It is also possible that the charging opening is closable by at least one face-side wall element of the furnace housing, which is axially displaceable in the longitudinal direction of the housing and is connected with the fan. In this embodiment, the fan is therefore displaced together with the wall element axially for opening or respectively closing the furnace. The charging takes place in this case by a C-hook. In combination with a cover, a coil gripper can also be used.

In a particularly preferred embodiment, the furnace housing is divided and has an axially separable housing part, which during operation of the furnace at least partially forms the receiving chamber. The separable housing part improves the handling and operating possibilities of the batch furnace. Thus, for example, the housing part can be configured exchangeably for adapting the length of the receiving chamber. Thereby, housing parts of differing length can be used, so that the length of the receiving chamber can be adapted to the length of the furnace material, for example the length of the coils. This has the advantage that the furnace volume can be adapted to the length of the furnace material which is respectively to be treated, which means a high degree of flexibility for the customer. Thereby, the useful volume is maximized and the flushing losses of the furnace are reduced, which contributes to a further increase in efficiency.

Additionally or alternatively, the separable housing part can have transport means for moving the housing part. This facilitates the equipping with the furnace material or respectively the removal of the furnace material, which together with the housing part can be moved in a simple manner by the transport means. A combination of the exchangeable housing part with the transport means is possible.

According to a further preferred embodiment, the separable housing part is constructed in one piece or divided with a cover or with pivotable wings. The one-piece variant is simple in construction. The divided variant enables a good access to the furnace material during charging or respectively removal.

Preferably, the housing part is hollow-cylindrical.

In the method according to the invention for the heat treatment of a furnace material, the furnace material is arranged in the receiving chamber of the batch furnace, in particular of the single chamber furnace or single coil furnace. The heat transfer medium which is heated in the furnace or outside the furnace, is blown by at least one, in particular by two fans onto the furnace material, in particular directly onto the furnace material, for the convective heat transfer.

BRIEF DESCRIPTION OF THE DRAWINGS

The invention is explained more closely with the aid of example embodiments with reference to the enclosed diagrammatic drawings with further details.

In these there are shown.

DETAILED DESCRIPTION OF THE INVENTION

Figure 1:
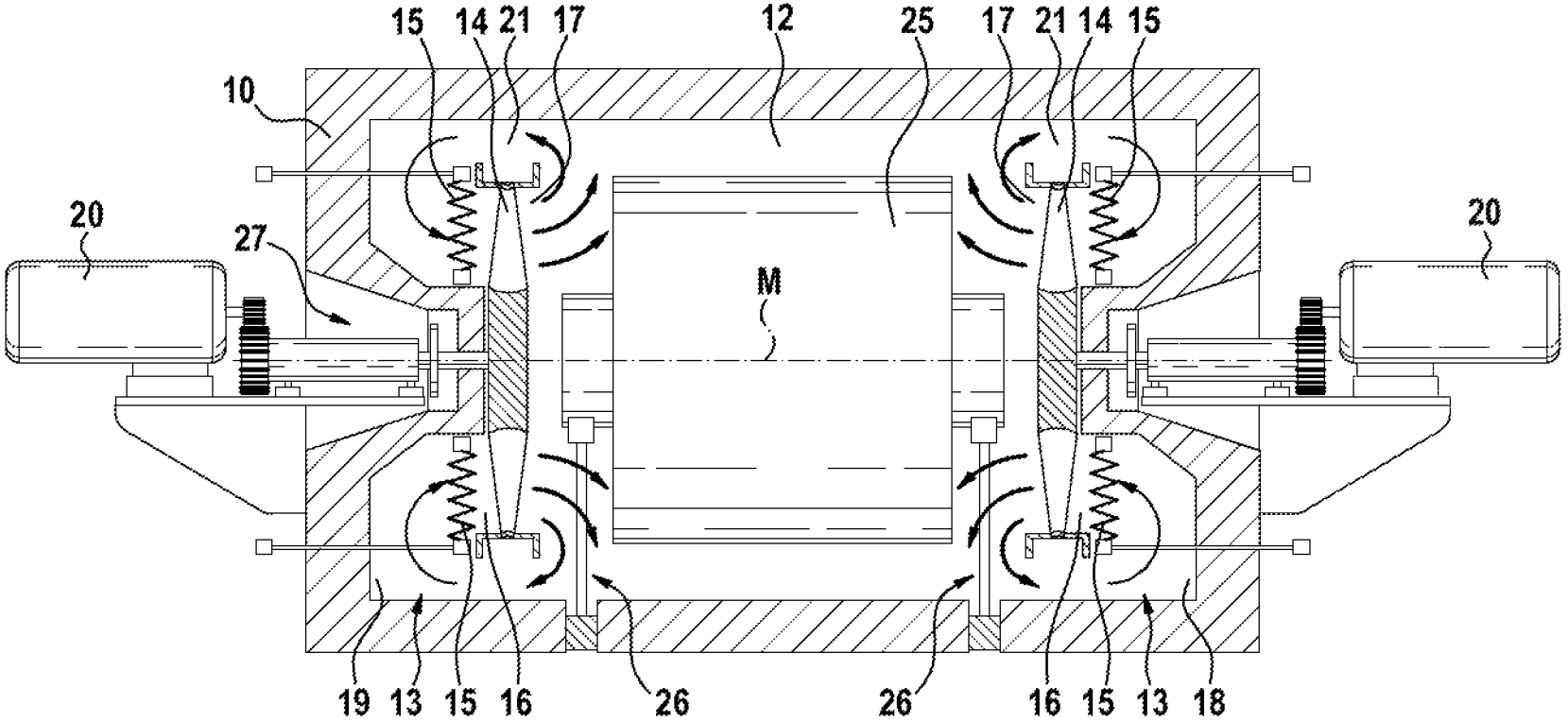
FIG. 1 the longitudinal section of a batch furnace according to an example embodiment according to the invention, with two fans arranged on the face side.

The batch furnace according to FIG. 1 is used preferably, but not exclusively, for the heat treatment of aluminum annealing material, for example of aluminum coils. The coil illustrated in FIG. 1 has reference number 25. The batch furnace is able to be used generally for coils (irrespective of material) or other annealing material.

The batch furnace is in practical terms a single coil furnace, which is adapted for the heat treatment of individual coils. The invention is also able to be applied to single chamber furnaces which are suitable for the heat treatment of billets, rolling ingots or coils.

The batch furnace has a furnace housing 10 with a thermal insulation. The furnace housing can have a cylindrical shape. Other furnace shapes are possible. The furnace housing 10 delimits a receiving chamber 12 in which the furnace material or respectively the annealing material is arranged during operation of the batch furnace. The concern here is with an individual receiving chamber 12. In the batch furnace according to FIG. 1, the receiving chamber 12 is charged with a coil, in particular an aluminum coil. For this, the receiving chamber 12 has a bearing arrangement 26 for the annealing material, in particular the aluminum coil. The bearing arrangement can be, for example, a bearing mounting or a bearing linkage and is connected to the base of the receiving chamber 12. The coil could also be deposited on its surface shell. Other mountings are possible.

In the unloaded state of the batch furnace, the receiving chamber 12 forms an empty free space. The receiving chamber is accessible through a closable charging opening 11, which is illustrated by way of example in different variants in FIGS. 3 to 5 and is explained in greater detail further below.

In the batch furnace according to FIG. 1, the receiving chamber is substantially hollow-cylindrical and is thereby adapted approximately to the shape of the coil which is to be heated.

The furnace housing 10 has a device for the convective heat transfer 13 onto the annealing material by a heat transfer medium. The heat transfer medium can be hot air, for example. Depending on the annealing material, a different heat transfer medium, for example exhaust gases of another furnace or protective gas can be used.

The device for convective heat transfer 13 comprises a fan 14 and a heating device 15, associated with the fan 14, for the heat transfer medium. In practical terms, the device for convective heat transfer 13 comprises two fans 14, with which respectively a heating device 15 is associated. The invention is not restricted to a particular number of fans 14 or respectively heating devices 15. It is also possible to provide generally more than one fan and more than one heating device in the furnace housing 10.

The arrangement of two fans 14 and two heating devices 15 is particularly advantageous for the heating of coils. In FIG. 1 it can be seen that the heating device 15 is arranged directly in front of the intake side 16 of the fan 14. This applies to both fans 14 or respectively the corresponding heating devices 15. The receiving chamber 12 directly adjoins the pressure side 17 of the fan 14. In other words, the receiving chamber 12 is delimited on both axial sides, i.e. in longitudinal direction of the furnace housing 10 by the fans 14 or respectively their pressure sides 17.

Alternatively or additionally to the heating devices 15 arranged on the intake side 16, further heating devices 15 can be arranged on the pressure side 17 of the fan 14. In this case, the heating devices 15, arranged on the pressure side 17, delimit the receiving chamber 12 in longitudinal direction of the furnace housing 10.

Instead of or additionally to the heating devices 15, the furnace housing 10 can have one or more inlets for a heat transfer medium (not illustrated) which is heated outside the furnace housing. The corresponding inlet(s) open on the intake side 16 or on the pressure side 17 of the fan 14 into the housing 10. The inlets for the externally heated heat transfer medium can be combined with the heating device 15.

As can be seen in FIG. 1, the furnace housing 10 is free of installations except for the fans 14, the heating devices 15, the bearing arrangement 26 for the coil 25 and any measuring devices, for example for the oxygen content, the temperature and the pressure. The receiving chamber 12 is at least free of nozzle channels, because the convective heat transfer takes place through the fans 14 and the heating device 15. Thereby, an open furnace volume is created, which means small pressure losses, small flushing losses and a small expenditure for the thermal insulation.

The heating device 15 overlaps at least partially, in particular completely, the effective area of the fan 14, but can also be placed in the annular gap between furnace housing and fan. The heating device 15 extends, in relation to the fan 14, in radial direction and along the circumference of the fan. Here, the heating device 15 has through-openings (not illustrated), through which the heat transfer medium can flow.

The heating device 15 can be constructed as a single heating element with a central energy supply or as separate heating elements with respectively their own energy supply.

In the example according to FIG. 1, the heating device 15 is constructed as electrical resistance heating. The electrical resistance heating has radiantly arranged heating coils, which extend radially from the inside outwards in relation to the fan 14. In the example according to FIG. 1, the heating coils overlap the blades of the fan 14, i.e. the length of the heating coils corresponds approximately to the blade length. The heat transfer medium can flow through between the heating coils. It is likewise possible to allow the resistance heating to run in a spiral shape from the rotation axis of the fan in the direction of the furnace housing, or to place the heating coils circumferentially in the annular gap between furnace housing and fan.

The fan- and heating units according to FIG. 1 are constructed symmetrically.

Instead of the electrical resistance heating, the heating device 15 can have one heating line or a plurality of heating lines for a gaseous heating medium. Hot air and hot gases, for example exhaust gases, come into use here. It is also possible to combine the resistance heating and the heating lines with one another, so that the batch furnace has a hybrid heating.

The heat transfer medium flows, during operation, past the heating device 15 and, in so doing, receives heat. The heated heat transfer medium flows through the fan 14 and exits on the pressure side (see thick arrows). There, the annealing material is acted upon in the receiving chamber 12 by the heated heat transfer medium.

For a compact construction, the fans 14 and the heating device in 15 are arranged respectively at the face sides 18, 19 of the hollow-cylindrical receiving chamber 12.

Thereby, the useful volume of the receiving chamber 12 is maximized.

The fan 14 is an axial fan.

The fans 14 have respectively a drive 20, in particular an electric motor, which is arranged outside the furnace housing 10. The electric motor or respectively generally the drive 20 is coupled directly to the fan 14 in a manner known per se, is connected to the fan by means of a belt drive or, in rare cases, is also connected to the fan via a gearing.

The furnace housing 10 has generally at the face sides 18, a substantially rotationally symmetrical recess 27, which extends into the furnace housing 10 and has a closed further end face.

In the example according to FIG. 1, the recess 27 has in practical terms an inwardly tapering portion, i.e. towards the receiving chamber 12, which continues into a cylindrical portion. The cylindrical portion is closed toward the receiving chamber 12. The recess 27 can have a different geometry, for example a continuously cylindrical or continuously conical geometry.

The recess 27 and the centre axis M of the furnace housing 10 are coaxially arranged. The mounting of the fan 14 is connected to the recess 27, in particular to the cylindrical portion. The fan is arranged parallel to the further face side of the recess 27. The heating device 15 is fastened to the wall of the recess 27, which wall is arranged in the furnace housing 10. Thereby, a coaxial arrangement of the heating device 15, of the fan 14 and of the drive shaft of the drive 20 is produced. In addition, by the recess 27 it is achieved that the fan 14 is arranged as close as possible to the mounting 26 for the annealing material in the receiving chamber 12. The drive 20, in practical terms the drive train, is arranged inside the recess 27 and therefore outside the furnace housing 10.

Between the fan 14 and in the furnace housing 10, an annular gap 21 is formed, which permits the circulation of the heat transfer medium in the receiving chamber 12 or respectively generally in the furnace housing 10. The circulation is characterized by the thick arrows on the pressure side 17 of the fan 14 and the thin arrows on the intake side 16. The heat transfer medium is therefore circulated in the receiving chamber 12 or respectively generally in the furnace housing 10, wherein the heated heat transfer medium flows in the direction of the annealing material 25 or respectively of the receiving chamber 12. The cooled heat transfer medium flows through the annular gap 21 back onto the intake side 16 of the fan 14 and is heated there by the heating device 15, in order to flow through the fan 14 back again onto the pressure side 17.

Figure 2:
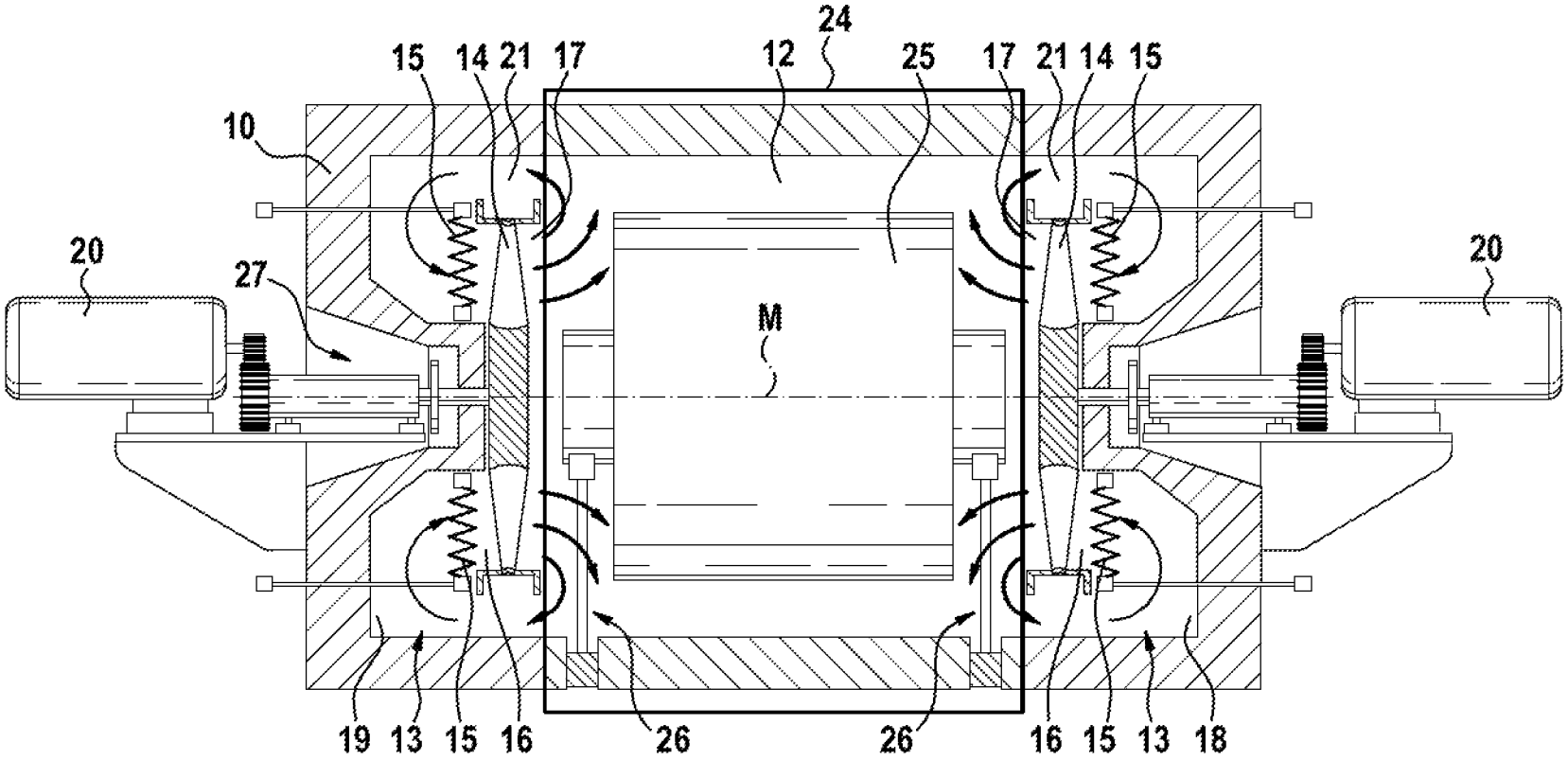
FIG. 2 the longitudinal section of a batch furnace according to a further example embodiment according to the invention with an exchangeable centre part.
Figure 3:
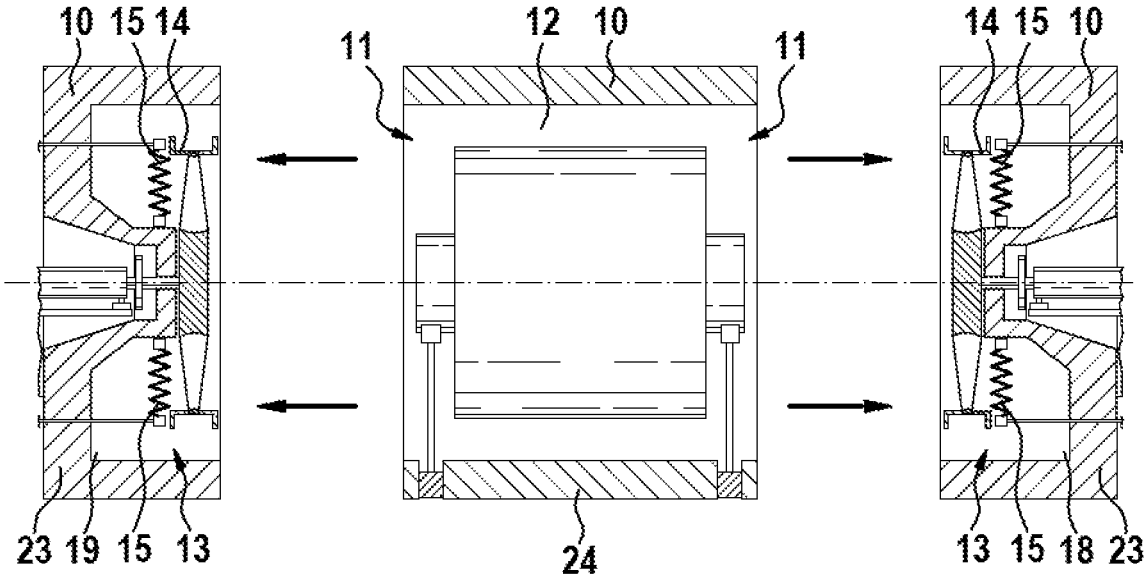
FIG. 3 the batch furnace according to FIG. 2 in separated state.

In the example according to FIG. 2, provision is made that the furnace housing 10 is divided and has an exchangeable housing part 24, in particular centre piece, which is designated by a box. In FIG. 3 there is illustrated how the housing part 24, in particular centre piece or respectively centre part, is separated from the two lateral wall elements 23, in order to exchange this. The batch furnace can therefore be adapted to different annealing material parts, in particular different coils, lengthwise. This has the advantage that the distance between the fans 14 and the coil 25 is also constant in the case of different lengths.

The batch furnace according to FIGS. 2, 3 offers in addition the possibility of opening or respectively closing the charging opening 11 by axial displacing of the lateral wall elements 23, so that the receiving chamber 12 can be charged by a C-hook or stacker. In combination with FIG. 4, a coil gripper is also able to be used.

Figure 4:
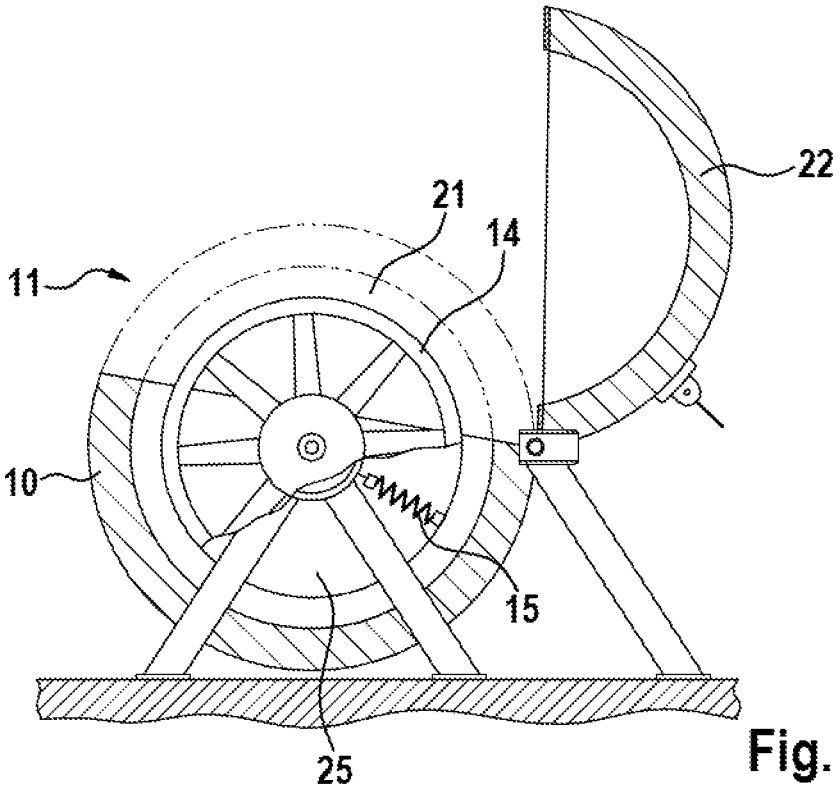
FIG. 4 the cross-section of a batch furnace according to a further example embodiment according to the invention, with a pivotable cover.

Alternatively, as illustrated in FIG. 4, the charging opening 11 can be opened or respectively closed by a cover 22, which can be pivoted about a rotation axis running in longitudinal direction of the furnace housing 10. This embodiment is particularly suitable for cylindrical furnace housings. The rotation axis is arranged laterally from the vertical centre plane. The cover 22 has a closure side running parallel to the rotation axis, which closure side is arranged on the other side of the vertical centre plane.

The fan 14 with the heating device 15 is arranged here in the stationary part of the furnace housing 10 and is not moved together with the cover 22.

Alternatively, two pivotable wings can be provided for opening and closing the batch furnace. The rotation axes of the wings are arranged opposite one another respectively laterally from the vertical centre plane. The two closure sides of the wings, therefore the wing sides which are arrested with one another in the closed position, are situated in the closed position in the vertical centre plane of the batch furnace. The wings are articulated on a base piece of the furnace housing. The wings form, together with the base piece, the surface shell of the hollow-cylindrical furnace housing.

Figure 5:
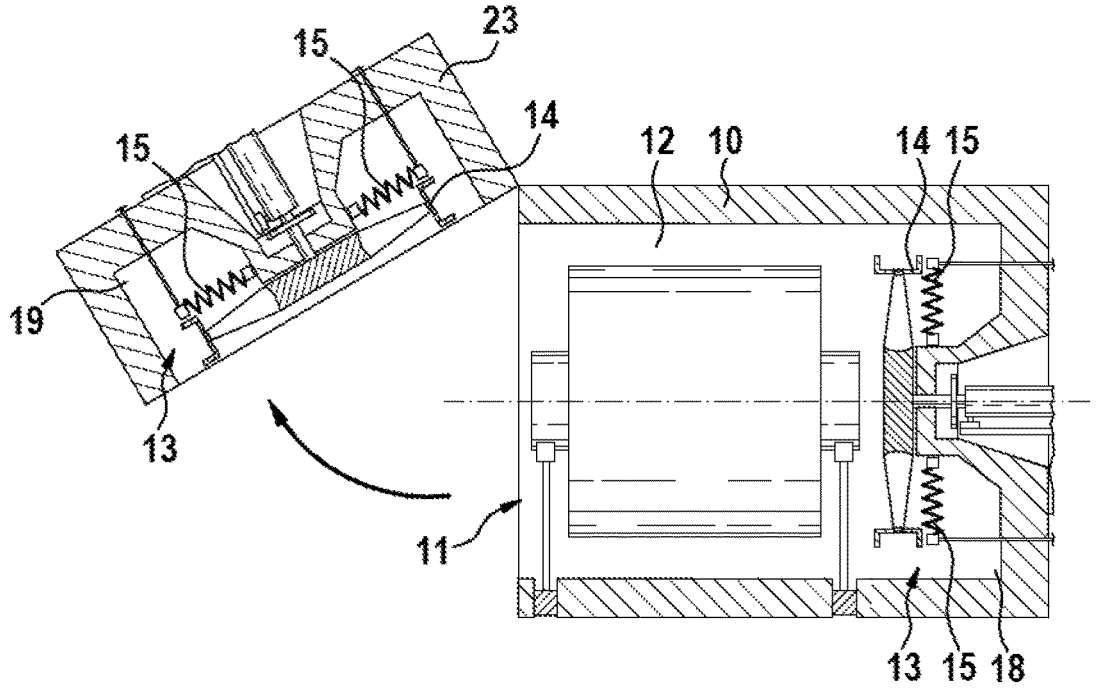
FIG. 5 the longitudinal section of a batch furnace according to a further example embodiment according to the invention, with a pivotable wall element, and FIG. 6 the longitudinal section of a batch furnace according to a further example embodiment according to the invention, with a movable centre part

In the example embodiment according to FIG. 5, the lateral wall opening 23 is pivotable about a rotation axis running transversely to the centre axis M, for opening or closing the charging opening 11. In this variant, the fan 14 and the heating device 15 are securely connected to the lateral wall element and are co-moved on opening or respectively closing of the charging opening 11.

Figure 6:
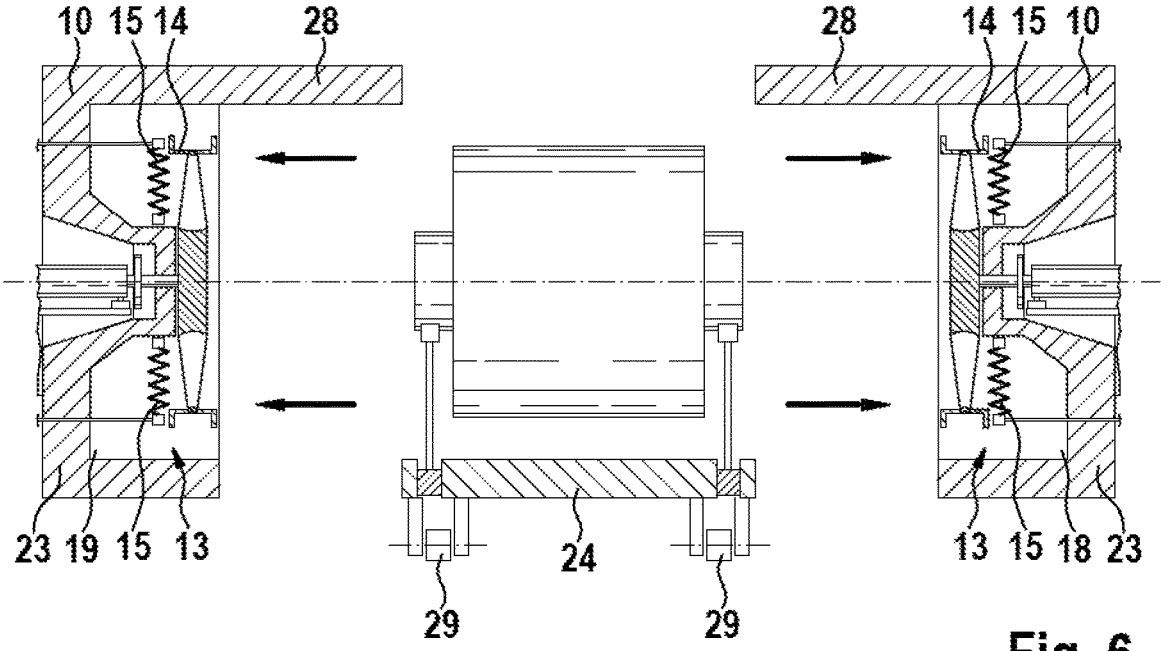

The example according to FIG. 6 relates to a variant of the batch furnace according to FIG. 3, in which the wall elements 23 are movable, in particular displaceable, axially, i.e. along the longitudinal axis of the batch furnace. With regard to the features which coincide in the embodiments according to FIG. 3 and FIG. 6, reference is to be made to the description concerning FIG. 3. In the example according to FIG. 6, the furnace housing is constructed having three parts. The two wall elements 23 and the housing part 24 form, in the closed position, i.e. during operation of the batch furnace, the furnace housing 21. In contrast to the example according to FIG. 3, in the embodiment according to FIG. 6 the housing part 24 is constructed as a base piece. The surface shell of the furnace housing 21 in the region of the housing part 24 is formed by the wall elements 23. The wall elements 23 have respectively a housing extension 28, which extend the surface shell of the wall elements 23 in axial direction, i.e. in longitudinal direction of the batch furnace. In the closed position, the housing extensions 28 overlap the housing part 24.

The housing part 24, constructed as base piece, is displaceable. For this, the housing part 24 has transport means 29, for example in the form of rollers (transport carriage). Other transport means are possible. The transport means 29 is constructed so that a movement of the housing part 24 transversely to the longitudinal direction of the batch furnace is possible. The furnace material is mounted on the housing part 24, as can be readily seen in FIG. 6. In practical terms, the coil stands on the transport carriage.

The batch furnace according to FIG. 6 functions as follows. After the heat treatment, the two outer wall elements 23 are withdrawn in axial direction from the housing part 24, as indicated by the arrows in longitudinal direction of the furnace housing 21. The coil is moved out from the furnace on the housing part 24 or respectively on the transport carriage and is taken away. The next coil which is to be treated, which is situated in waiting position on a further housing part 24 or respectively transport carriage, is moved between the two wall elements 23. Subsequently, the wall elements 23 are moved axially in the direction of the housing part 24 for closing the batch furnace. Then the two housing extensions 28 are connected to one another and the wall elements 23 are connected to the housing part 24. When the closed position of the batch furnace is reached, the heat treatment begins.

LIST OF REFERENCE NUMBERS

10 furnace housing
11 charging opening
12 receiving chamber
13 device for convective heat transfer
14 fan
15 heating device
16 intake side
17 pressure side
18 face sides
19 face sides
20 drive
21 annular gap
22 cover
23 wall elements
24 housing part/centre piece
25 coil
26 bearing arrangement
27 recess
28 housing extension
29 transport means

What is claimed is:

1. A batch furnace for annealing a furnace material, the batch furnace comprising:

a furnace housing comprising a closable charging opening;

a transfer assembly for convective heat transfer onto the furnace material by a heat transfer medium, the transfer assembly comprising a first fan and a second fan, each fan disposed within the furnace housing, each fan comprising an intake side and a pressure side, a first heating device associated with the second fan, wherein each heating device is for heating the heat transfer medium and each heating device is arranged directly in front of the intake side of the respective fan; and a receiving chamber for receiving the furnace material, wherein, the receiving chamber is disposed on the pressure side of the first fan and the pressure side of the second fan for directly receiving the heat transfer medium from each fan, wherein the receiving chamber directly adjoins the pressure side of the first fan and the pressure side of the second fan;

wherein the furnace housing comprises a first face-side wall element and a second face-side wall element, the first face-side wall element and the second face-side wall element for opening and closing the receiving chamber, each face-side wall element axially displaceable in a longitudinal direction of the furnace housing; and wherein a first assembly comprises the first face-side wall element, the first fan, and the first heating device;

wherein the first face-side wall element is connected to the first fan and to the first heating device;

wherein a second assembly comprises the second face-side wall element, the second fan, and the second heating device;

wherein the second face-side wall element is connected to the seond fan and to the second heating device, and wherein the two assemblies displace axially.

2. The batch furnace according to claim 1, wherein a nozzle channel is not present in the receiving chamber.

3. The batch furnace according to claim 1, wherein each heating device comprises an electrical resistance heating element or a heating line for a gaseous heating medium.

4. The batch furnace according to claim 1, wherein the receiving chamber has a first side and a second side;

wherein the first fan faces the first side of the receiving chamber and the second fan faces the second side of the receiving chamber; and wherein at least one inlet is associated with the first fan or the second fan.

5. The batch furnace according to claim 1, wherein the receiving chamber comprises the heat transfer medium and the annular gap, and wherein the first fan or the second fan is arranged at a face side of the receiving chamber.

6. The batch furnace according to claim 1, wherein the first fan comprises a drive, the drive disposed outside the furnace housing.

7. The batch furnace according to claim 1, wherein an annular gap circulates the heat transfer medium and the annular gap is located between the furnace housing and the first fan and the second fan.

8. The batch furnace according to claim 1, further comprising a bearing arrangement for a coil disposed in the receiving chamber.

9. The batch furnace according to claim 1, wherein the furnace housing is divided and comprises an axially-separable housing part, the axially-separable housing part during operation of the furnace forms at least partially the receiving chamber.

10. The batch furnace of claim 1, wherein the first fan and the second fan are arranged in an axis parallel to a base on which the batch furnace rests.

11. The batch furnace according to claim 9, wherein the axially-separable housing part has a transport carriage for separating the axially-separable housing part from a furnace housing part.

12. The batch furnace according to claim 11, wherein the axially-separable housing part is constructed in one piece, is divided with a cover element, or is divided with pivotable wings.

13. The batch furnace according to claim 11, wherein the axially-separable housing part is exchangeable with another axially-separable housing part.

14. A method for heat treatment of a furnace material in a batch furnace, the batch furnace comprising:

a furnace housing comprising a closable charging opening, a transfer assembly for convective heat transfer onto the furnace material by a heat transfer medium, the transfer assembly comprising a first fan and a second fan, each fan disposed within the furnace housing, each fan comprising an intake side and a pressure side, a first heating device associated with the first fan and a second heating device associated with the second fan, wherein each heating device is for heating the heat transder medium and each heating device is disposed directly in front of the intake side of the respective fan, and a receiving chamber for receiving the furnace material, wherein the receiving chamber is disposed on the respective pressure side of the first fan and the pressure of the second fan for directly receiving the heat transfer medium from each fan, wherein the receiving chamber directly adjoins the pressure side of the first fan and the pressure side of the second fan;

wherein the furnace housing comprises a first face-side wall element and a second face-side wall element, the first face-side wall element and the second face-side wall element for opening and closing the receiving chamber, each face-side wall element axially displaceable in a longitudinal direction of the furnace housing; and wherein a first assembly comprises the first face-side wall element, the first fan, and the first heating device;

wherein the first face-side wall element is connected to the first fan and to the first heating device;

wherein a second assembly comprisies the second face-side wall element, the second fan, and the second heating device;

wherein the second face-side wall element is connected to the second fan and to the second heating heating device;

wherein the two assemblies displace axially;

the method comprising the steps of:

(a) arranging in the receiving chamber the furnace material, (b) blowing, by the first fan and the second fan, the heat transfer medium onto the furnace material for convective heat transfer.

15. The method of claim 14, wherein step (b) is performed by blowing the heat transfer medium directly onto the furnace material.

16. The method of claim 14, further comprising a bearing arrangement for a coil disposed in the receiving chamber.

17. A batch furnace for annealing a furnace material, the batch furnace comprising:

a furnace housing comprising a closable charging opening;

a transfer assembly for convective heat transfer onto the furnace material by a heat transfer medium, the transfer assembly comprising at least one inlet for receiving the heat transfer medium after the heat transfer medium has been heated externally from outside the batch furnace, a first fan and a second fan, each fan comprising an intake side and a pressure side, wherein each fan is disposed within the furnace housing;

a receiving chamber for receiving the furnace material, wherein the receiving chamber is disposed on the pressure side of the first fan and the pressure side of the second fan for directly receiving the heat transfer medium from each fan, wherein the receiving chamber directly adjoins the pressure side of the first fan and the pressure side of the second fan;

wherein the furnace housing comprises a first face-side wall element and a second face-side wall element, the first face-side wall element and the second face-side wall element for opening and closing the receiving chamber, each face-side wall element axially displaceable in a longitudinal direction of the furnace housing; and where a first assembly comprises the first face-side wall element, the first fan, and a first heating device;

wherein the first face-side wall element is connected to the first fan and to the first heating device;

wherein a second assembly comprises the second face-side wall element, the second fan, and a second heating device;

wherein the second face-side wall element is connected to the second fan and to the second heating device; and wherein the two assemblies displace axially.

18. A batch furnace for annealing a furnace material, the batch furnace comprising:

a furnace housing comprising a closable charging opening;

a transfer assembly for convective heat transfer onto the furnace material by a heat transfer medium, the transfer assembly comprising a first fan and a second fan, each fan disposed within the furnace housing, each fan comprising an intake side and a pressure side, a first heating device associated with the first face and a second heasting device associated with the second fan, wherein each heating device is for heating the heat transfer medium and each heating device is arranged directly behind the pressure side of the respective fan;

a receiving chamber for receiving the furnace material, the receiving chamber disposed on the respective pressure side of the first fan and the pressure side of the second fan for directly receiving the heat transfer medium from the fans;

wherein the furnace housing is divided and comprises an axially-separable housing part which during operating of the furnace forms at least partially the receiving chamber, the receiving chamber directly adjoins the pressure side of the first fan and the pressure side of the second fan;

wherein the furnace housing comprises a first face-side wall element and a second face-side wall element, the first face-side wall element and the second face-side wall element for opening and closing the receiving chamber, each face-side wall element axially displaceable in a longitudinal direction of the furnace housing; and wherein a first assembly comprises the first face-side wall element, the first fan, and the first heating device;

wherein the first face-side wall element is connected to the first fan and to the first heating device;

wherein a second assembly comprises the second face-side wall element, the second fan, and the second heating device;

wherein the second face-side wall element is connected to the second fan and to the second heating device; and wherein the two assemblies displace axially.

* * * * *